US006116795A

United States Patent [19]

Ogasawara

[11] Patent Number: 6,116,795

[45] Date of Patent: Sep. 12, 2000

[54] PAPER FEED CONTROL METHOD

[75] Inventor: Masashi Ogasawara, Iwate-ken, Japan

[73] Assignee: ALPS Electric Co., Ltd., Tokyo, Japan

[21] Appl. No.: 09/399,849

[22] Filed: Sep. 21, 1999

[30] Foreign Application Priority Data

Sep. 21, 1998 [JP] Japan ..... 10-266508

[51] Int. Cl.[7] ..... B41J 11/42

[52] U.S. Cl. ..... 400/582; 271/266

[58] Field of Search ..... 400/582, 636.2, 400/583, 636, 636.1, 630, 706; 271/266, 264

[56] References Cited

U.S. PATENT DOCUMENTS

| | | | |
|---|---|---|---|
| 5,385,341 | 1/1995 | Yamada et al. | 271/265 |
| 5,529,414 | 6/1996 | Katana et al. . | |
| 5,702,191 | 12/1997 | Kakizaki et al. | 400/582 |
| 5,779,278 | 7/1998 | Kikuchi | 400/616.2 |
| 6,017,160 | 1/2000 | Sato et al. | 400/582 |

FOREIGN PATENT DOCUMENTS 8-2032 1/1996 Japan .

*Primary Examiner*—John S. Hilten
*Assistant Examiner*—Darius N. Cone
*Attorney, Agent, or Firm*—Brinks Hofer Gilson & Lione

[57] ABSTRACT

To maintain a high precision of a line feeding amount of a paper sheet regardless of the processing precision of a paper feed roller. Relationships between paper line feeding amounts of a paper feed roller at division positions divided into a plurality of parts with reference to an origin of a rotation angle of the paper feed roller and step counts of a paper feed motor are measured to calculate a correction value for correcting the step counts of the paper feed motor, the step counts of the paper feed motor in a line feeding operation are controlled on the basis of the correction value. When a paper feeding operation of a paper sheet whose type is except for the type of the paper sheet used in measurement is performed, a central step count of a base step count at a desired division position is calculated, and the central step count is compared with the measured central step counts of the base steps at the division positions. A measured correction value at a division position whose central step count is closest to the central step count at the desired division position is referred to, correction values of another type of paper sheet are calculated, and the step counts of the paper feed motor is controlled on the basis of the correction values.

2 Claims, 6 Drawing Sheets

PAPER FEED CONTROL METHOD

BACKGROUND OF THE INVENTION (1) Field of the Invention

The present invention relates to a paper feed control method and, more particularly, to a paper feed control method which can maintain a high paper feeding precision of a paper sheet by a paper feed roller.

(2) Description of the Prior Art

Printers which can record characters, images, or the like on paper sheets by driving recording heads such as thermal heads, ink-jet heads are popularly used.

In such a conventional printer, while a paper sheet is transported between a platen and a printing head, the recording head is driven on the basis of recording information, so that characters, images, or the like are recorded on a paper sheet. A paper feeding apparatus in which a paper feed roller for transporting the paper sheet by a predetermined amount to perform a line feeding operation is arranged in the printer.

In a recent recording apparatus, image recording having more high quality is demanded. In order to perform image recording having high quality, an improvement in precision of a line feeding amount is demanded. For this reason, processing precision for the outside dimensions, deflection, and degree of roundness of the paper feed roller are improved, and production variations are reduced so as to improve the production quality of a paper feed roller itself or to devise paper feed control.

However, in order to improve the production quality of the paper feed roller itself to improve the precision of a line feeding amount in the conventional paper feeding apparatus described above, the paper feed roller requires an excellent processing precision, e.g., an allowance of a deflection precision of 5 $\mu$m or less. The paper feed roller having an excellent processing precision has the following problems. That is, a yield of the paper feed roller is low, a lot of effort and long time are required to produce the paper feed roller, and an economical load is heavy.

When paper feed control is performed to improve the precision of a line feeding amount in the paper feeding apparatus, the paper feeding apparatus requires paper feed control which calculates a line feeding amount as a paper feeding amount required for a paper feeding operation, calculates a rotation amount of a paper feed motor for rotationally driving a paper feed roller on the basis of the outer periphery length or the like of the paper feed roller, and rotates the paper feed motor by the rotation amount to suppress variations in line feeding amounts.

As the paper feed control for suppressing the variations in line feeding amounts, control described in Japanese Unexamined Patent Publication No. 8-2032 is known. According to the paper feed control described in this publication, as shown in FIG. 6, a sensor roller 25 having an outer periphery length which is almost equal to the length of one line of a recording head is arranged in a paper feeding apparatus 1" such that the sensor roller 25 is in contact with a part of a paper sheet P transported by a paper feed roller 2. A sensor rotor 26 which is coaxially rotated with the sensor roller 25 is detected by a photosensor 27 to detect a paper feeding amount, and a paper feeding amount obtained by a paper feed motor 6 is controlled, so that a line feeding amount can be correctly determined.

However, the paper feeding apparatus has the following problems. That is, the sensor roller 25, the highly precise complex photosensor 27 for detecting a rotation amount of the sensor roller 25, and a control unit 31 for detecting a paper feeding amount from the rotation amount of the sensor roller 25 on the basis of a detection result of the photosensor 27 to control a paper feeding amount obtained by the paper feed motor 6 must be arranged in the paper feeding apparatus itself to increase the number of parts and to make an economical load heavy, so that a reduction in weight is hindered.

In addition, since the paper feeding apparatus causes the sensor roller to detect a line feeding amount every recording on a paper sheet, a line feeding operation requires a long period of time. In particular, a recent high-resolution paper feeding apparatus having a small line feeding amount has the following problems. That is, a line feeding operation requires a longer period of time, a recording rate decreases.

Furthermore, in recent years, as paper sheets used in recording, various types of paper sheets such as a plain paper sheet, a post card, an OHP paper sheet, an iron printing paper sheet, a seal paper sheet, and a dedicated paper sheet whose surface smoothness is improved are used. Since variations in line feeding amounts are caused by variations in contact pressures between a paper feed roller and paper sheets or the types of paper sheets used in recording, the following problems are posed. That is, an arithmetic process time in a control unit is long, a large-capacity memory is required, and software is inevitably large. As a result, a lot of effort and long time are required to develop the software, and an economical load is heavy.

SUMMARY OF THE INVENTION

It is an object of the present invention to provide a paper feed control method which can maintain a high line feeding precision regardless of a processing precision of a paper feed roller.

More specifically, according to the present invention, there is provided a paper feed control method in which a paper feed motor having a detection portion serving as a measurement point for the origin of a rotation angle is driven by a paper feed motor, the detection portion is detected by an origin detection device, and a paper sheet is transported while correction control of a line feeding amount on the paper sheet is performed depending on the rotation angle of the paper feed roller, characterized in that in advance, by using a correction value acquisition system, one rotation of the paper feed roller is divided into a plurality of parts with reference to the origin of the rotation angle of the paper feed roller, addresses are set for respective division positions, relationships between paper line feeding amounts of the paper feed roller at the division positions and step counts of the paper feed motor are measured with respect to a certain reference paper sheet, correction values for correcting the step counts of the paper feed motor when the paper sheet is transported are calculated, and the correction values are set at the respective addresses, in this state, the paper feed roller applied to this measurement is arranged on a paper feeding apparatus to control the step counts of the paper feed motor in the line feeding operation on the basis of the correction values, and when a paper feeding operation of a paper sheet whose type is different from that of the reference paper sheet is performed, a base step count depending on the type of the paper sheet is calculated by another means in advance, central step counts of base step counts are calculated for the respective division positions, the central step counts are compared with the central step counts of the base step counts at the respective division positions measured with respect to the reference paper sheet, a central step count, in case of the reference paper sheet, which is closest to a central step count in case of the different type of paper sheet is selected, a correction value in case of the different type of paper sheet is calculated with reference to the correction value at an address to which the central step count in case of the reference paper sheet belongs, and the step counts of the paper feed motor in case of the different type of paper sheet are controlled on the basis of the correction value.

It is an object of the present invention to calculate a correction value of a step count of the paper feed motor depending on the type of a paper sheet in advance, to drive and control the paper feed motor on the basis of the correction count of the step count to control a paper line feeding amount, and to maintain a high precision of the paper line feeding amount in a unit of $\mu$m. In addition, it is another object to make a high-precise complex detection device, a control unit, and the like unnecessary to reduce the number of parts, to manufacture the apparatus at low costs, and to achieve a light weight. It is still another object that, since the paper line feeding amount is controlled on the basis of the correction value, the data amount of the correction value can be reduced, an arithmetic process time in a line feeding operation can be shortened, and control can be performed by a small-capacity memory and small-size software at low cost, and that, since the line feeding operation can be performed within a short period of time, a recording rate is increased even in a recent high-resolution paper feeding apparatus having a small line feeding amount. In addition, it is still another object that, since, in calculation of correction amounts of various types of paper sheets, a central step count at an address in case of a reference paper sheet is made almost equal to a central step count at an address in case of a different type of paper sheet, control of line feeding amounts appropriate to various types of paper sheets is performed.

Furthermore, according to another aspect of the present invention, there is provided a paper feed control method characterized in that the correction value at the address to which the referred central step count in case of the reference paper sheet belongs is arithmetically operated such that weighting is changed depending on a change in line feeding amount depending on a type of paper sheet to calculate a correction value in case of a different type of paper sheet.

It is an object of the present invention to perform control of line feeding amounts appropriate to various types of paper sheets.

DETAILED DESCRIPTION OF THE PREFERRED EMBODIMENTS

Figure 1:
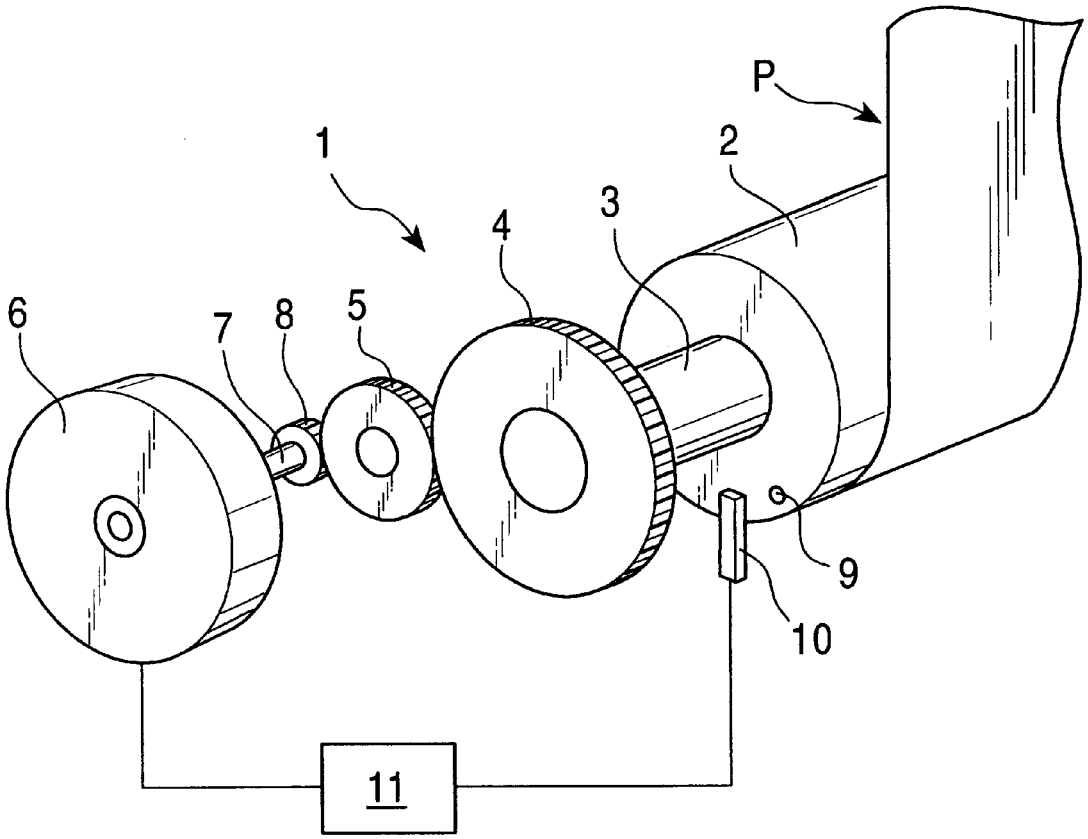
FIG. 1 is a perspective view showing a main part of an embodiment of a paper feeding apparatus to which a paper feeding apparatus according to the present invention is applied.

An embodiment of the present invention will be described below with reference to FIG. 1 to FIG. 5. FIG. 1 shows an embodiment of a paper feeding apparatus for a printer to which a paper feed control method according to the present invention is applied. This paper feeding apparatus 1 has a paper feed roller 2 for transporting a paper sheet P to a predetermined recording position (not shown). The paper feed roller 2 is rotationally supported such that the rotating shaft of the paper feed roller 2 is pivotally supported by a printer frame (not shown). A roller drive gear 4 is attached to one end portion of the rotating shaft 3 of the paper feed roller 2 such that the roller drive gear 4 is coaxial with the paper feed roller 2, and a transmission gear 5 is meshed with the roller drive gear 4. In addition, a motor gear 8 fixed to an output shaft 7 of the paper feed motor 6 constituted by, e.g., a stepping motor or the like is meshed with the transmission gear 5.

A detection portion 9 which serves as the origin (home position) of the rotation angle of the paper feed roller 2 in recording is arranged on one end face of the paper feed roller 2, the detection portion 9 consists of, e.g., a reflective seal which reflects light, a reflective plate, a paint, or the like. An origin detection device 10 such as a reflective photosensor is arranged near one end face of the paper feed roller 2 such that the origin detection device 10 is opposite to the detection portion 9. The origin detection device 10 detects the origin of the rotation angle of the paper feed roller 2 each time the paper feed roller 2 rotates once. In addition, a control device 11 are electrically connected to the origin detection device 10 and the paper feed motor 6, so that a detection signal of the detection portion 9 by the origin detection device 10 is output to the control device 11. The detection portion 9 may consist of a projection or the like, and the origin detection device 10 may be of a contact type.

The paper feed motor 6 is driven on the basis of a control signal sent from the control device 11 to rotationally drive the paper feed roller 2 through the motor gear 8, the transmission gear 5, and the roller drive gear 4, so that the paper sheet P inserted between the paper feed roller 2 and a press contact roller (not shown) is held therebetween and transported.

Figure 2:
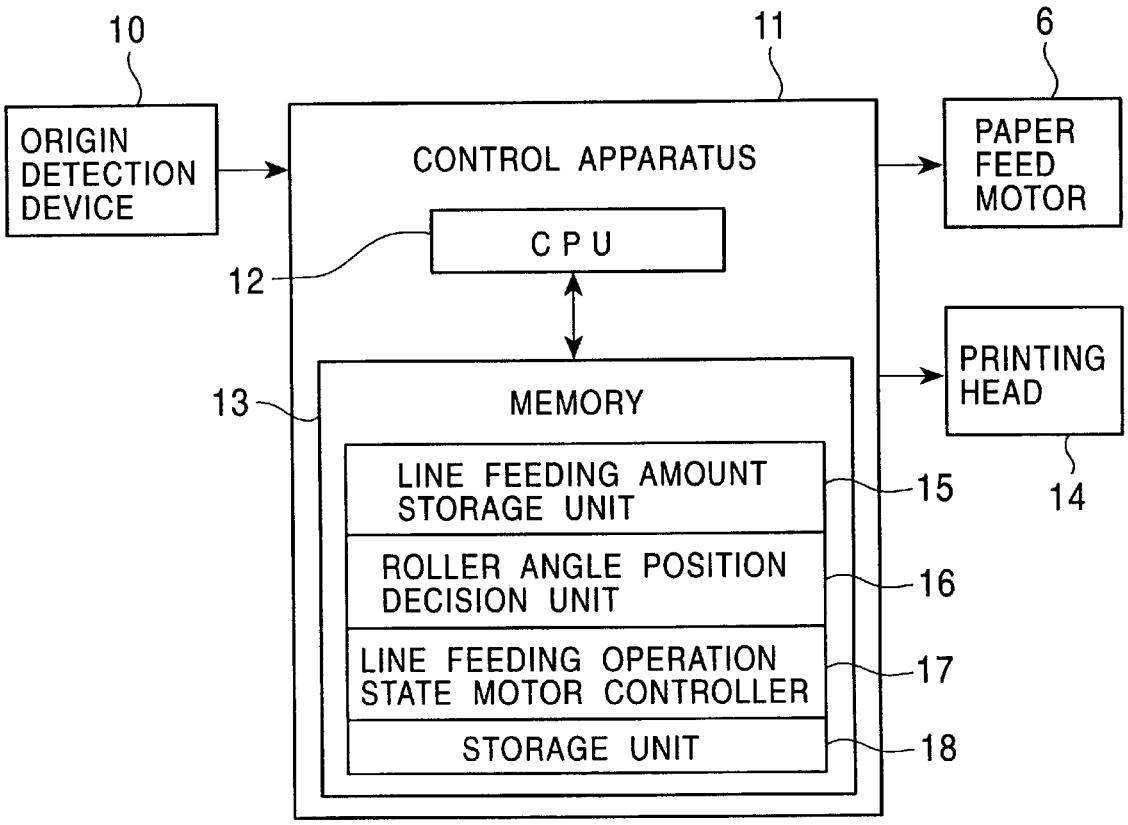
FIG. 2 is a block diagram for explaining the details of a control device shown in FIG. 1.

FIG. 2 shows an embodiment of the control device described above. The control device 11 has a CPU 12 and a memory 13 constituted by a ROM having an appropriate capacity, a RAM, and the like. The origin detection device 10, the paper feed motor 6, a printing head 14 such as a thermal head are electrically connected to the control device 11. The paper feed motor 6 and the printing head 14 are connected to each other through drive circuits (not shown) such as controllers which respectively drive the paper feed motor 6 and the printing head 14.

In the memory 13, a line feeding amount storage unit 15, a roller angle position decision unit 16, a line feeding operation state motor controller 17, and a storage unit 18 are arranged.

A correction value for correcting a rotation amount of the paper feed motor 6 required for a line feeding operation of the paper sheet P by the paper feed roller 2 is stored in the line feeding amount storage unit 15, and a program for deciding an angle position of the paper feed roller 2 on the basis of a detection signal obtained by causing the origin detection device 10 to detect the detection portion 9. In addition, a program for controlling a rotation amount of the paper feed motor 6 required for a line feeding operation on the basis of the angle position of the paper feed roller 2 decided by the roller angle position decision unit 16 and the correction value stored in the line feeding amount storage unit 15 in a line feeding operation is stored in the line feeding operation state motor controller 17. Various types of programs and data for performing various operation controls, such as a program for controlling drive of the printing head 14 on the basis of recording information in a recording operation, a program related to an abnormality detecting operation and supply of the paper sheet P, and data used in recording are stored in the storage unit 18.

Figure 3:
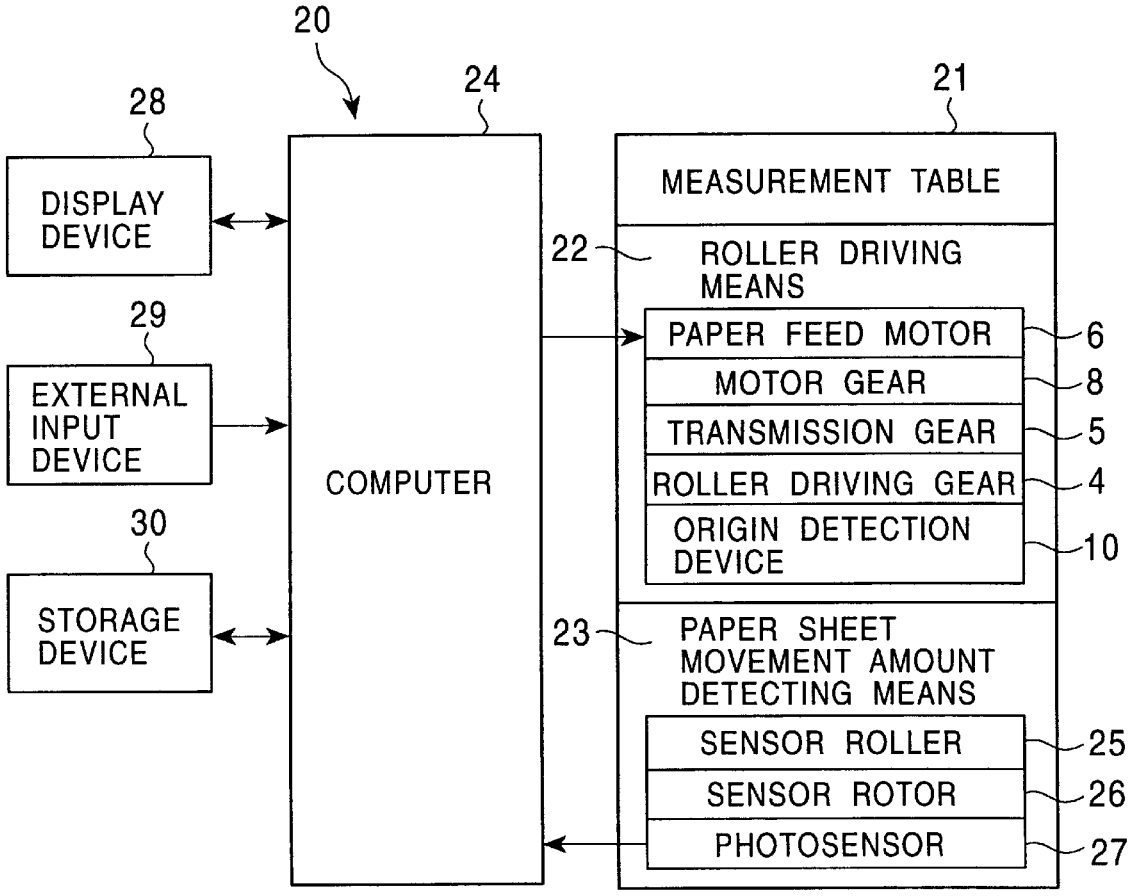
FIG. 3 is a block diagram showing an embodiment of a correction value acquisition system applied to the paper feed control method of the present invention.
Figure 5:
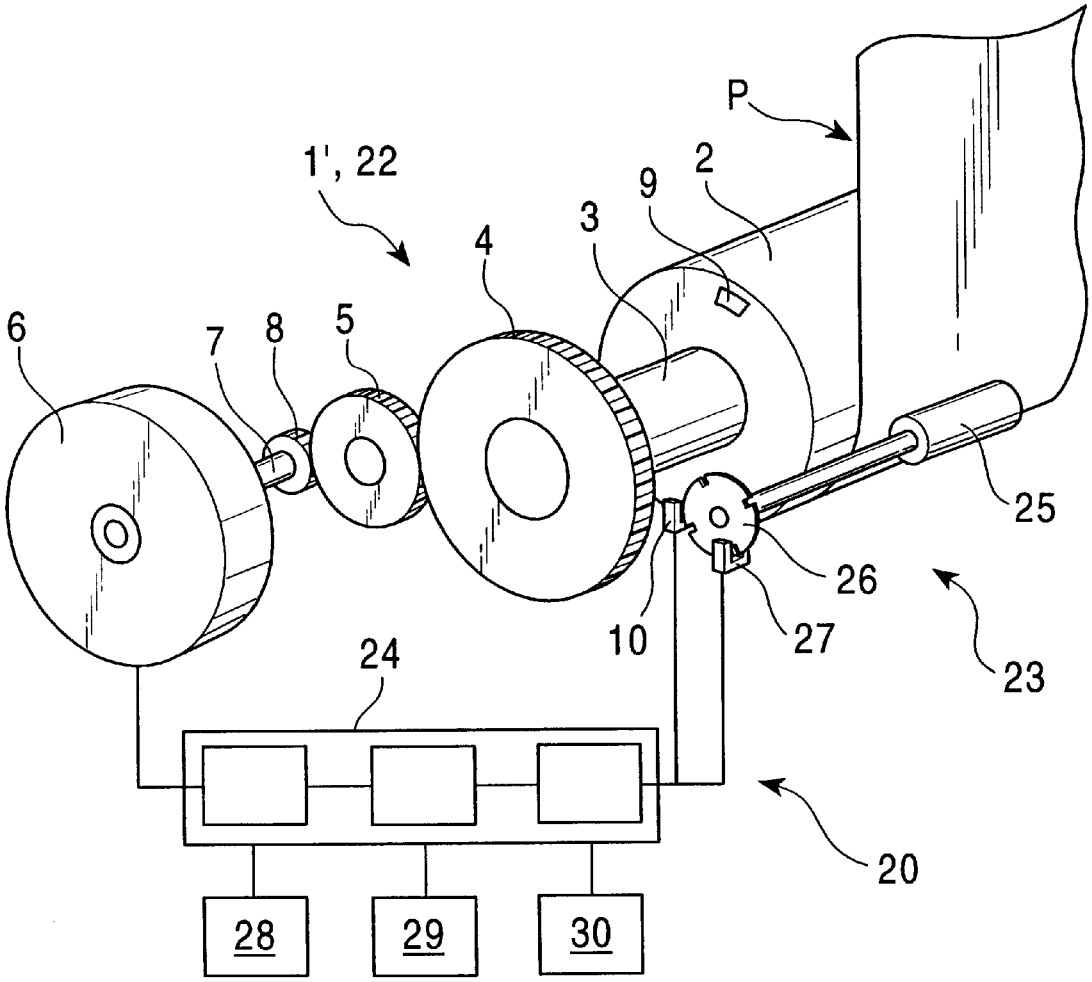
FIG. 5 is a perspective view showing an embodiment of the correction value acquisition system in FIG. 2.
Figure 6:
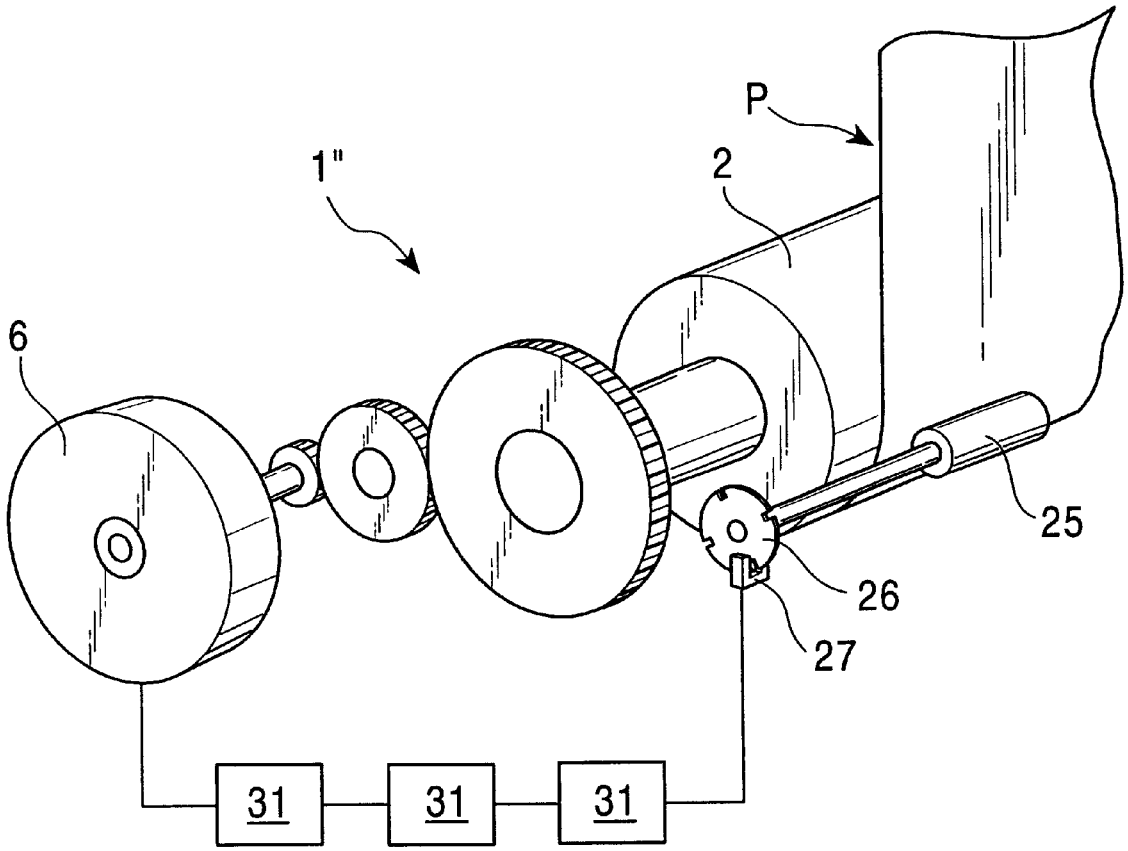
FIG. 6 PRIOR ART
FIG. 6 is a perspective view showing a main part of a paper feeding apparatus to which a conventional paper feed control method is applied.

FIGS. 3 and 5 show an embodiment of the configuration of a correction value acquisition system for acquiring a correction value stored in the line feeding amount storage unit 15. This correction value acquisition system 20 has a measurement table 21 to which the paper feed roller 2 is detachably connected and which rotationally supports the paper feed roller 2. In the measurement table 21, a roller driving means 22 for driving the paper feed roller 2 and a paper sheet movement amount detecting means 23 for detecting a movement amount of the paper sheet P obtained by the origin detection device 10 and the paper feed roller 2 are arranged.

The roller driving means 22 has a configuration in which a paper feeding apparatus 1' is used as shown in FIG. 5. The paper feeding apparatus 1' is constituted by the paper feed motor 6, the motor gear 8, the transmission gear 5, the roller drive gear 4, and the origin detection device 10.

A computer 24 is electrically connected to the paper feed motor 6 and the origin detection device 10, and the paper feed motor 6 is controlled on the basis of a control signal output from the computer 24. A detection signal detected by the origin detection device 10 is output to the computer 24, so that the origin of the rotation angle of the paper feed roller 2 is detected on the basis of the detection signal.

The paper sheet movement amount detecting means 23 is to detect a movement amount of the paper sheet P transported by the paper feed roller 2. In this embodiment, the paper sheet movement amount detecting means 23 is constituted by a sensor roller 25 which is brought into contact with the paper feed roller 2 through the paper sheet P in a paper feeding operation, a sensor rotor 26 which is integrally rotated with the sensor roller 25 and in which a plurality of slits are formed, a photosensor (photo-interrupter) 27 for detecting the slits of the sensor rotor 26. More specifically, the sensor rotor 26 and the photosensor 27 serve as an encoder for converting an analog amounts of the rotation angle of the sensor roller 25 into a digital amount. The computer 24 is electrically connected to the photosensor 27, so that a detection signal of a rotation angle obtained when the sensor roller 25 rotates can be output to the computer 24.

As the paper sheet movement amount detecting means 23, a means for directly measuring a movement amount of the paper sheet P may be used.

A display device 28 for displaying data such as a measurement result, an external input device 29 such as a keyboard or a mouse for inputting a control command to the correction value acquisition system 20, and a storage device 30 for storing various types of programs and data such as a program or data for controlling the correction value acquisition system 20 as a whole or for storing new data are connected to the computer 24.

A paper feed control method of the present invention using the paper feeding apparatus 1 having the configuration described above will be described below.

First, a means for acquiring a correction value stored in the line feeding amount storage unit 15 by using the correction value acquisition system 20 will be described below with reference to the drawings.

It is assumed that the number of line feed dots is set to be 236 (10.03 mm). In this case, the sensor roller 25 is designed such that the number of rotations of the sensor roller 25 slightly exceeds one when a paper feeding operation (line feeding operation) of a normal step of the paper feed motor 6 is performed by an appropriate jig by using a reference roller whose outer periphery length is correctly known and in which a correction step for the normal step of the paper feed motor 6 is known, the sensor roller 25. An average step count of the paper feed motor 6 at this time is calculated to be used as a calibration value of the sensor roller 25.

The paper feed roller 2 to which the roller drive gear 4 is fixed is attached to the measurement table 21. Thereafter, for example, a paper sheet P such as a thick paper sheet is held between the paper feed roller 2 and the sensor roller 25 as a reference paper sheet to prepare for a paper feeding operation. The external input device 29 is operated to drive the paper feed motor 6 of the roller driving means 22, thereby rotating the paper feed roller 2 to remove stress generated by setting the paper sheet P. Thereafter, the paper feed roller 2 is stopped at a position where the origin detection device 10 detects the detection portion 9 of the paper feed roller 2, so that the paper feed roller 2 is positioned at the origin of a rotation angle.

Thereafter, the external input device 29, and the paper feed motor 6 of the roller driving means 22 is driven to rotate the paper feed roller 2. A step count of the paper feed motor 6 at this time and a rotation angle are measured for positions obtained by dividing the periphery of the paper feed roller 2 into 64 parts. By the measurement results and a correction value calculation program stored in the computer 24, an actual step count serving as a rotation amount of the paper feed motor 6 obtained by adding the calibration value to a rotation count of the sensor roller 25, an average of the difference between the actual step count and a reference step of the paper feed motor 6 required for a line feeding operation of the paper sheet P is calculated, so that a correction value set with reference to the origin of the rotation angle of the paper feed roller 2 is obtained. The correction value is rounded off to the decimal places to obtain an integer value.

Figure 4:
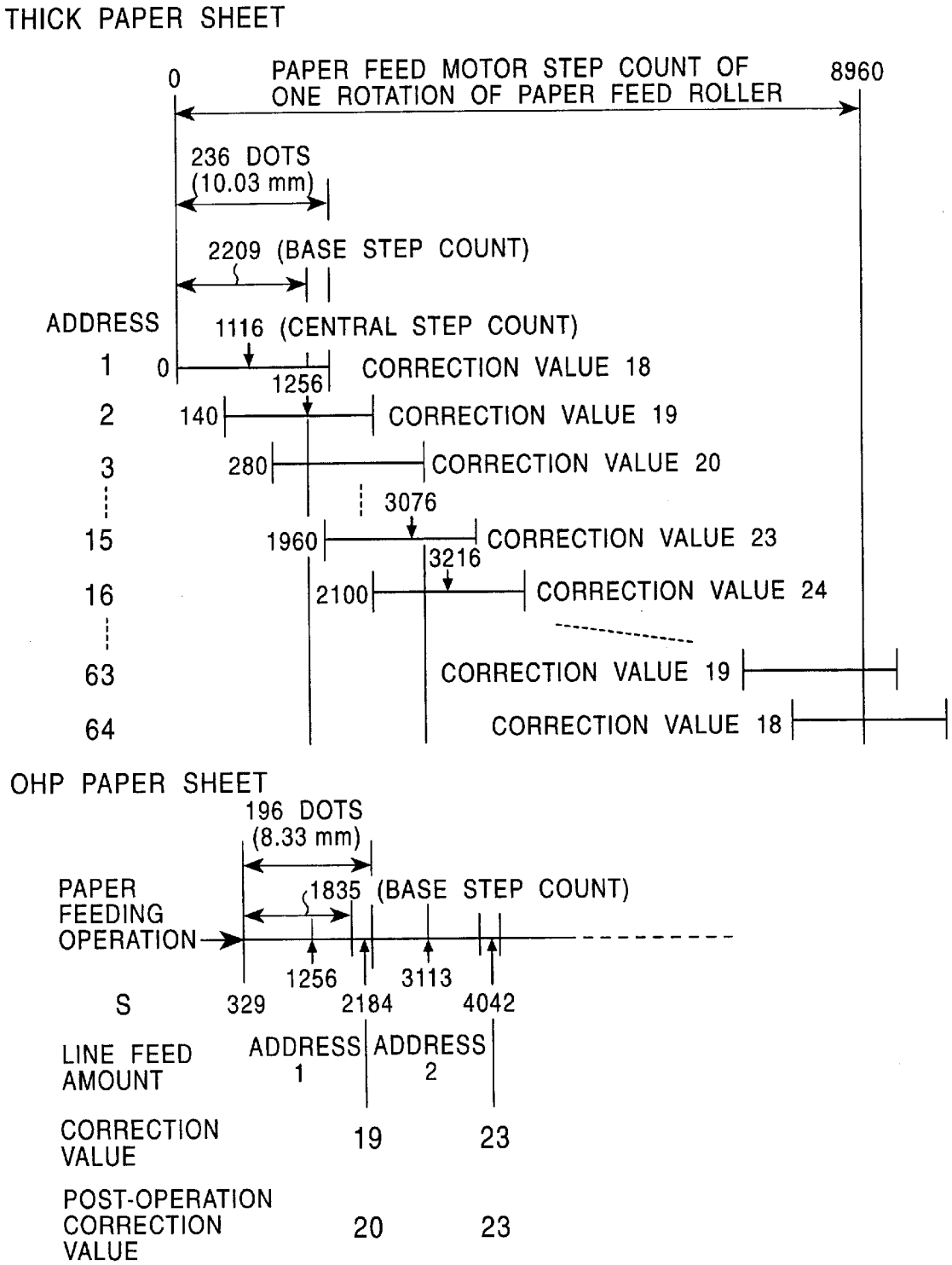
FIG. 4 is a chart for explaining a correction value acquisition means according to the paper feed control method of the present invention.

More specifically, as shown in FIG. 4, it is assumed that a step count at which the paper feed motor 6 is driven in one rotation of the paper feed roller 2 is 8,960. In this case, when the periphery of the paper feed roller 2 is divided into 64 parts, step counts at which the paper feed motor 6 is driven for the respective division positions are different from each other by 140 steps. Address 1 to 64 are set to the division positions obtained by dividing the periphery of the paper feed roller 2, respectively. A base step count depending on the type of the paper sheet P is calculated in advance. This step count is a step count which is equal to an appropriate line feeding amount when the correction value is added to the base step count, and is a characteristic value changing depending on the type of each paper sheet P.

The base step count is 2,209 in case of a thick paper sheet, correction values are measured for the division positions of address 1 to address 64 on the basis of the base step count. For example, according to this embodiment, the correction value at address 1 is 18, the correction value at address 2 is 19, and the correction value at address 3 is 20.

The paper feed roller 2 used in measurement is incorporated in the paper feeding apparatus 1, and the correction values of the paper feed roller 2 are stored in the line feeding amount storage unit 15 of the memory 13 of the paper feeding apparatus 1 as a correction table.

When the correction values at the respective addresses are measured as described above, correction values are calculated with respect to another type of paper sheets P.

More specifically, on the basis of the correction values at the addresses measured by using the reference paper sheet, correction values of the paper sheet P are calculated by an arithmetic operation on the basis of the following equation. This correction values are also rounded off to the decimal places to obtain integer values.

(correction values of paper sheet)=(average of correction values)+((correction values)−(average of correction values))×(the number of line feed dots of paper sheet)/(the number of line feed dots of measured paper sheet).

In this equation, the average of correction values is a value obtained by averaging the correction values at the addresses calculated by measurement using the reference paper sheet. The correction values are the correction values at the respective addresses calculated by measurement. However, in this embodiment, the measured correction value at an address corresponding to a required address is not used, but the central step count of the base step count at the required address is calculated, and this central step count is compared with the calculated central step count of the base step at the address, so that the measured correction value at the address whose central step count is closest to the central step count at the desired address is referred to. As the central step count of the base step count, a characteristic value calculated on the basis of the base step count of each paper sheet P is used.

For example, when correction values are calculated with respect to an OHP paper sheet P, the following manner is used. That is, as shown in FIG. 4, it is assumed that the base step count of the OHP paper sheet P is 1,835, that the number of line feed dots is 196 (8.33 mm), that the average of the measured correction values at respective addresses is 23, and that the central step count of the base step count at address 1 of the OHP paper sheet P is 1,256. In this case, as an address corresponding to the measured central step count at the address, address 2 whose central step count is 1,256 is referred to.

Since the correction value at address 2 is 19, a correction value at address 1 of the OHP paper sheet is arithmetically operated by the correction value of 19 according to the equation described above. More specifically, since the average of the correction values is 23; the correction value, 19; the number of line feed dots of the paper sheet P, 196; and the measured number of line feed dots of the paper sheet P, 236, the correction value of the OHP paper sheet P is 20 according to the equation. The same arithmetic operation is performed with respect to the addresses of the OHP paper sheet P as described above to calculate correction values at the addresses. The correction values are stored in the line feeding amount storage unit 15 of the memory 13 of the paper feeding apparatus 1 as a correction table.

In general, the correction values of various types of paper sheets P are mainly dependent on the deflection precision of the paper feed roller 2. When the number of line feed dots (absolute value of line feed amount) changes, weighting of only a deflection component must be changed. However, in this embodiment, since the central step count at the desired address is made almost equal to the measured central step count at the address, weighting of the deflection component can be appropriately changed.

A paper feeding method in this embodiment will be described below.

In this embodiment, when the paper feeding apparatus 1 is powered on, a conventionally known initializing process is performed, and the detection portion 9 of the paper feed roller 2 is detected by the origin detection device 10, so that the origin of the rotation angle of the paper feed roller 2 is detected.

A paper sheet P is held between the paper feed roller 2 and a press contact roller (not shown), and the paper feed motor 6 is driven to rotate the paper feed roller 2, so that the paper sheet P is transported by desired predetermined amounts to perform a line feeding operation. In this line feeding operation, the roller angle position decision unit 16 decides the angle position of the paper feed roller 2, i.e., a drive step count of the paper feed motor 6 with reference to the origin of the rotation angle of the paper feed roller 2, and the line feeding operation state motor controller 17 controls a step count of the paper feed motor 6 on the basis of the angle position of the paper feed roller 2 decided by the roller angle position decision unit 16 and the correction values stored in the line feeding amount storage unit 15. More specifically, in the line feeding operation, the line feeding operation state motor controller 17 calls a correction value which is closest to the angle position of the paper feed roller 2 decided by the roller angle position decision unit 16 from the correction values stored in the line feeding amount storage unit 15, and the drive step count of the paper feed motor 6 is corrected on the basis of the correction value.

Therefore, in this embodiment, the correction value of the step count of the paper feed motor 6 is calculated depending on the type of the paper sheet P in advance, and the paper feed motor 6 is driven and controlled on the basis of the correction value of the step count to control the line feeding amount of the paper sheet P. For this reason, a high precision of the line feeding amount of the paper sheet P can be maintained in a unit of $\mu$m regardless of the processing precision of the paper feed roller 2.

Unlike the conventional method, a high-precise complex detection device for detecting a rotation amount of the paper feed roller 2 and a complex control unit or the like for controlling a feeding amount of the paper sheet P by the paper feed motor 6 on the basis of a detection result of the detection device are not necessary. As a result, the number of parts can be reduced, the paper feeding apparatus can be manufactured at low costs, and a light weight can also be achieved.

Since the line feeding amount of the paper sheet P is controlled on the basis of the correction values calculated in advance, the data amount of the correction values can be reduced. An arithmetic process time in the line feeding operation state motor controller 17 is short, and control can be performed by the small-capacity memory 13 and small-size software. The software can be developed by a small deal of effort within a short period of time, and the software can be manufactured at low costs. Since a line feeding operation can be performed within a short period of time, a recording rate can be increased even in a recent high-resolution paper feeding apparatus 1 having a small line feeding amount.

When the correction values of various types of paper sheets P are calculated, the central step count at a desired address is made almost equal to the measured central step count at the address by using a reference paper sheet. For this reason, weighting of a deflection component can be appropriately changed, and appropriate control of line feeding amounts can be performed with respect to the various types of paper sheets P.

The present invention is not limited to the embodiments described above, and the present invention can be variously changed as needed.

As described above, in a paper feed control method according to an aspect of the present invention, a correction value of a step count of a paper feed motor is calculated depending on the type of a paper sheet in advance, the paper feed motor is driven and controlled on the basis of the correction value of the step count to control a line feeding amount of the paper sheet. For this reason, a high precision of a line feeding amount of the paper sheet can be maintained regardless of a processing precision of a paper feed roller. In addition, unlike a conventional method, a high-precise complex detection device, a complex control unit, and the like are not necessary, the number of parts can be reduced, the paper feeding apparatus can be manufactured at low costs, and a light weight can also be achieved. Furthermore, since a line feeding amount of the paper sheet is controlled on the basis of the correction value calculated in advance, the data amount of the correction value can be reduced, an arithmetic process time is short, and control can be performed by a small-capacity memory and small-size software. The software can be developed by a small deal of effort within a short period of time, and the software can be manufactured at low costs. Since a line feeding operation can be performed within a short period of time, a recording rate can be increased even in a recent high-resolution paper feeding apparatus having a small line feeding amount. When the correction values of various types of paper sheets P are calculated, the central step count at a desired address is made almost equal to the measured central step count at the address by using a reference paper sheet. For this reason, appropriate control of line feeding amounts can be performed with respect to the various types of paper sheets.

According to another aspect of the present invention, a measured correction value at a division position whose central step count is closest to the central step count at a desired division position is referred to, and the referred correction value is arithmetically operated such that weighting is changed according to a change in line feeding amount depending on the type of a paper sheet, so that correction values of another type of paper sheet are calculated. For this reason, the following advantage and the like can be achieved. That is, weighting of a deflection control is appropriately changed, so that control of line feeding amounts appropriate to various types of paper sheets can be performed.

What is claimed is:

1. A paper feed control method in which a paper feed motor having a detection portion serving as a measurement point for the origin of a rotation angle is driven by a paper feed motor, the detection portion is detected by an origin detection device, and a paper sheet is transported while correction control provides a line feeding amount on the paper sheet depending on the rotation angle of the paper feed roller, characterized in that providing a correction value acquisition system;

dividing one rotation of the paper feed roller into a plurality of parts with reference to the origin of the rotation angle of the paper feed roller;

setting addresses for respective division positions, relationships between paper line feeding amounts of the paper fed roller at the division positions and step counts of the paper feed motor are measured with respect to a certain reference paper sheet;

calculating correction values for correcting the step counts of the paper feed motor when the paper sheet is transported;

allowing the correction to be set at their respective addresses;

arranging the paper feed roller applied to this measurement on a paper feeding apparatus in the line feeding operation basing the correction values, and a paper feeding operation of a paper sheet whose type is different from that of the reference paper sheet to control the step counts of the paper feed motor, a base step count depending on the type of the paper sheet is calculated by another means in advance, central step counts of base step counts are calculated for the respective division positions;

comparing the central step counts with the central step counts of the base step counts at the respective division positions measured with respect to the reference paper sheet, a central step count, in case of the reference paper sheet, which is closest to a central step count in case of the different type of paper sheet is selected;

calculating a correction value in case of the different type of paper sheet to provide reference to the correction value at an address to which the central step count in case of the reference paper sheet belongs, and the step counts of the paper feed motor in case of the different type of paper sheet are controlled on the basis of the correction value.

2. A paper feed control method according to claim 1, characterized in that the correction value at the address to which the referred central step count is provided along with a reference paper sheet arithmetically operated such that weighting is changed depending on a change in line feeding amount depending on a type of paper sheet to calculate a correction value in case of a different type of paper sheet.

* * * * *